United States Patent [19]

Norbutas et al.

[11] 3,964,375

[45] June 22, 1976

[54] METHOD AND APPARATUS FOR PROVIDING CONTAINERS WITH FOLDED CAPS

[75] Inventors: Stanley R. Norbutas, Glenview; Thomas B. Domenz, Schaumburg; Jan Mieleszuk, Chicago, all of Ill.

[73] Assignee: Signode Corporation, Glenview, Ill.

[22] Filed: Oct. 18, 1974

[21] Appl. No.: 516,035

[52] U.S. Cl. ..... 93/36.5 R; 93/55.1 M; 93/55.1 P

[51] Int. Cl.[2] ..... B31B 49/02

[58] Field of Search ..... 93/36 B, 36.5 R, 36.5 SS, 93/36.8, 39.1 R, 39.1 P, 39.2, 39.3, 55.1 R, 55.1 M, 55.1 P, 54 R, 54.2

[56] References Cited

UNITED STATES PATENTS

| | | | |
|---|---|---|---|
| 2,905,066 | 9/1959 | Winkler | 93/55.1 M |
| 3,283,673 | 11/1966 | Gettelman | 93/55.1 M X |
| 3,589,249 | 6/1971 | Norbutas et al. | 93/55.1 R |
| 3,835,619 | 9/1974 | Reisman | 93/55.1 R X |

*Primary Examiner*—James F. Coan
*Attorney, Agent, or Firm*—Dressler, Goldsmith, Clement & Gordon, Ltd.

[57] ABSTRACT

A container cap having flat flanges extending outwardly therefrom is presented on first folding means above a container tube having flanges extending outwardly from the walls thereof. The first folding means are pivoted to raise the cap and to form first fold portions in the cap flanges which are positioned in a pickup cavity. The cap is supported by the free end of each flange on a ledge at the base of the cavity. The container tube is elevated and second folding means fold the first fold portions of the cap flanges into underlying relationship with the container flanges as the container rises, whereby each container flange is substantially encompassed by a U-shaped cap flange. Continued elevation of the container causes the flanges to engage downwardly tapered bearing surfaces which fold the flanges into parallel relationship with the wall of the container tube to interlockingly fold the cap to the container.

8 Claims, 14 Drawing Figures

30
101
102
103
350
82
69
24
50
45
38a
39
35
38b
39
39
S
351
36

37
41
41
40
34
39
38a
39
46b
39
38b
39
36
35
46c
46a
46
42
41
41
36

C
102
103
112a
116
117
118
125
126
202
203
225
226
230
231
240
241
242
245
246
247
248
249
250
251
252
253
254
255
256
257
309
310
311
312
314
316
317
320
321
356
357
58
59
60
61
62
63
64
65
66
67
68
69
70
72
73
74
75
6
8

METHOD AND APPARATUS FOR PROVIDING CONTAINERS WITH FOLDED CAPS

BACKGROUND OF THE INVENTION

The present invention relates generally to apparatus for connecting a top end closure to a container tube and, more particularly, to an improved flange folding mechanism for folding flanges extending from the container closure and the body of the container.

In packaging large items, particularly appliances, such as, refrigerators, stoves, and the like, it has become customary to place a container tube over the article and then to connect end caps or closures to the tube after it has been placed over the article to provide a closed package for shipment. It has been found desirable to provide a positive interconnection between the cap and the container prior to the securement of a ligature thereto.

Thus, in more recent packaging of articles of the above type, the container tube has a flange which includes a first portion extending substantially perpendicularly from the container tube and a second portion extending outwardly from the first portion in a slightly spaced relation to the wall of the tube. The container top cap includes a flange having a first portion which extends downwardly outside of the second portion of the tube flange, a second portion which extends inwardly from the end of the first portion and a third portion which extends upwardly from the end of the second portion and between the second portion of the tube flange and the wall of the container. Such an arrangement has been very satisfactory in that it virtually eliminates the possibility of the cap or end closure being separated from the container tube without the complete destruction of one or both of the above-mentioned flanges.

One type of flange-folding mechanism adapted for producing an interlocking flange arrangement at the bottom of the container tube is disclosed in Norbutas et al. U.S. Pat. No. 3,589,249. Nonetheless, it has heretofore been difficult to produce a proper folding of the respective flanges of the top closure and the tube. With the increased acceptance of interlocked containers and end closures, more reliable and rugged folding mechanisms have been sought which can meet the present production requirements which demand high rates of output. For various reasons, none of the prior mechanisms has been completely satisfactory in producing top interlocked flange containers.

SUMMARY OF THE INVENTION

The present invention provides an automatic folding apparatus which is capable of being incorporated into a packaging assembly line. The flanges of a container tube and top end cap are interlockingly folded so the container flange is substantially encompassed by a U-shaped cap flange.

The folding apparatus includes two pairs of opposed folding mechanisms positioned above the path of the tops of container tubes. Each pair of folding mechanisms is self-adjusting in response to the size of the container cap to be folded and means are provided for feeding the cap into the folding mechanisms. Each of the folding mechanisms includes a first folding member which receives the container cap thereon and forms first fold portions at the outer edges of the container cap flange to provide a cap having a generally downwardly facing U-shaped cross section.

A container tube is lifted upwardly by an elevator to place the flanges of the container into underlying engagement with the flat portion of the container cap. During a uniform upward lifting of the container, the first fold portions of the cap are folded inwardly beneath the flanges of the container flange. A bearing surface, above the second folding members, acts to bring the flanges into substantial parallel relationship with the walls of the container, and a ligature is secured thereabout. The elevator then lowers the capped container back to the assembly line elevation and the container is removed. The positioning and preforming of the container cap and uniform upward movement of the container tube provides a simple and rugged means for providing end cap interlocking folds which are capable of meeting the production requirements of 400 units per hour on assembly lines. Due to the variety of container sizes encountered on assembly lines, the present apparatus provides an easily-operated, self-adjusting folding mechanism which assures proper interlocking folding of the cap and container flanges.

DETAILED DESCRIPTION OF A PREFERRED EMBODIMENT

While this invention is susceptible of embodiment of many different forms, the following detailed description and the attached drawings disclose one specific embodiment with the understanding that the present disclosure is to be considered as exemplary and is not intended to limit the invention to the embodiment illustrated.

Figure 1:
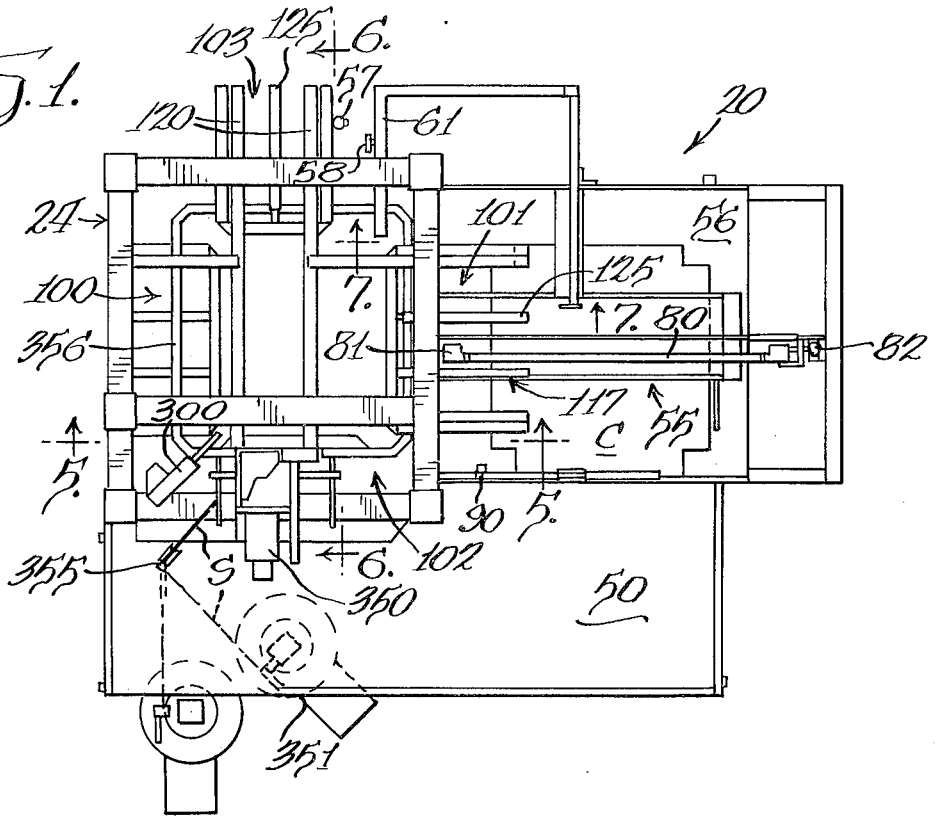
FIG. 1 is a schematic top plan view of a folding apparatus according to the present invention.
Figure 2:
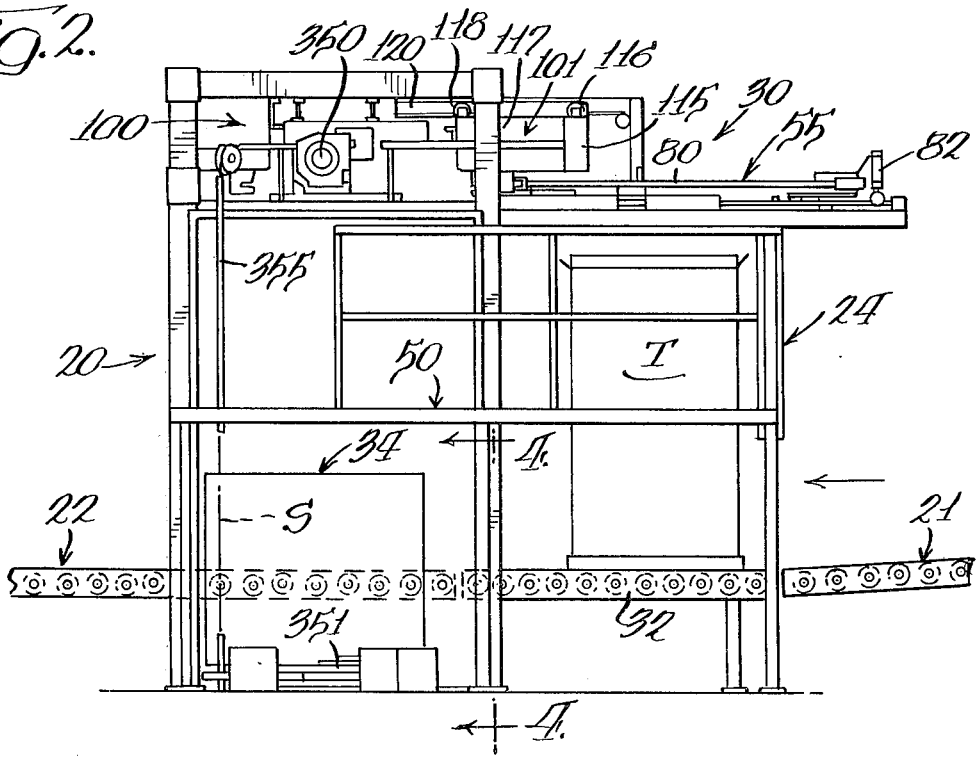
FIG. 2 is a side elevation view of the apparatus shown in FIG. 1.
Figure 3:
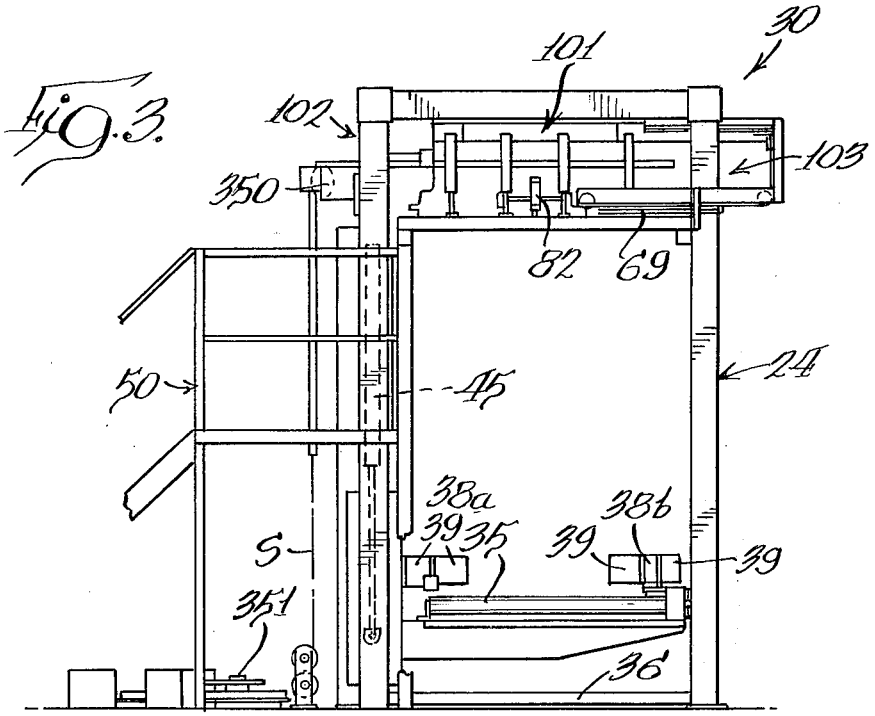
FIG. 3 is an end elevation view of the folding apparatus.

FIGS. 1–3 show the folding apparatus 20 installed in an assembly line between input conveyor 21 and output conveyor 22 which transport container tubes T to and from the folding apparatus. Folding apparatus 20 includes a frame 24 which defines a generally rectangular-shaped passageway through which container tubes T having appliances, such as, refrigerators, therein pass. Frame 24 supports the cap-handling and folding mechanism 30, to be described in detail below, above the path of the container tubes. Container tubes T are fed along input conveyor 21 and are received on a transfer conveyor 32 positioned at the end of the conveyor 21. Conveyor 32 is driven independently by means, such as, a fluid drive mechanism as is known in the art, to transfer the container tube to a container elevator 34.

Figure 4:
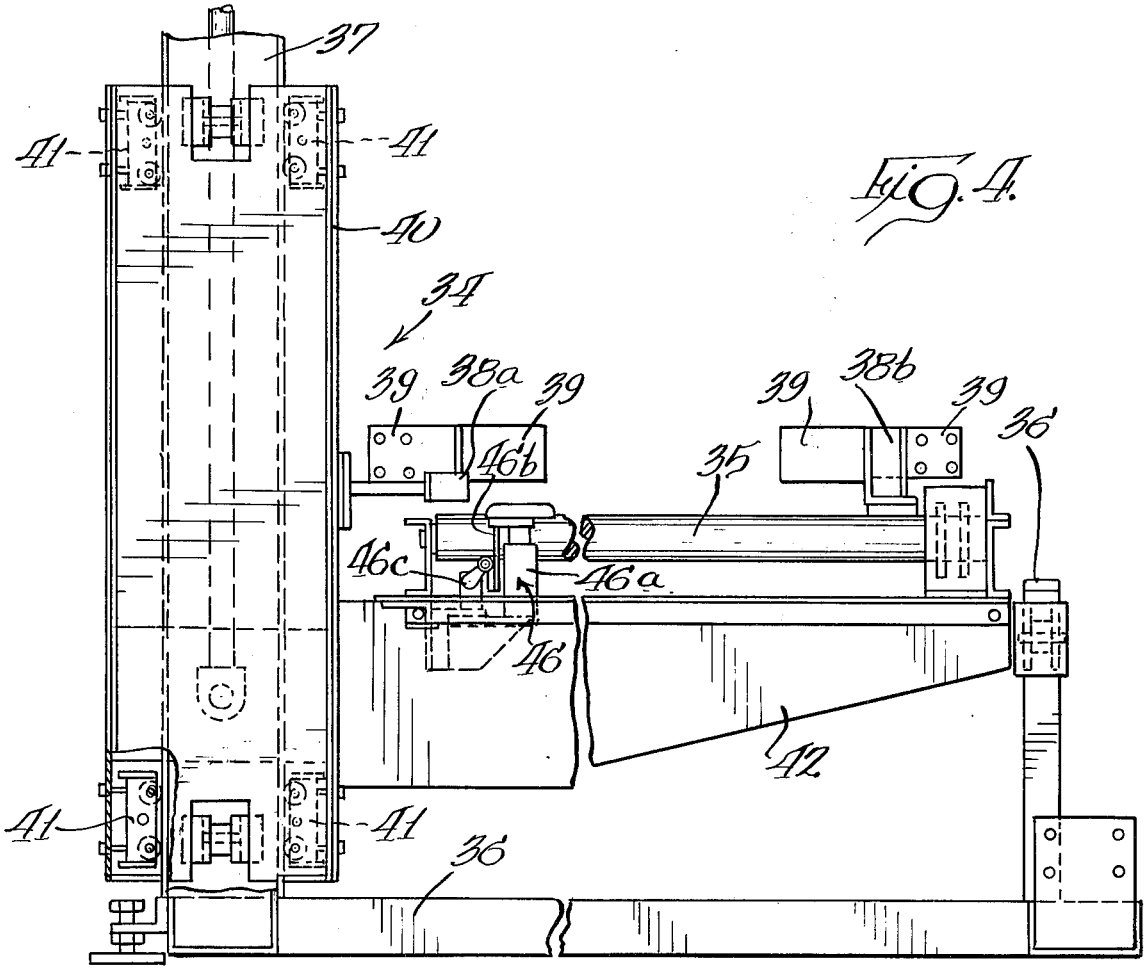
FIG. 4 is an enlarged fragmentary sectional view taken generally along line 4—4 in FIG. 2 illustrating the container elevator.

Elevator 34, FIG. 4, includes a base frame 36 and two spaced apart uprights 37. Positioned on each upright is a trolley member 40 which slidably engages the upright by means of bearings 41. Extending outwardly from each of the trolley members below the elevation of the path of the container tubes is a lift support 42 on which is mounted conveyor 35. Conveyor 35 is also power-driven to convey the container tube between a set of transverse guide members and end stops 38*a* and 38*b*, which position the container tube beneath the folding mechanism 30 at the left-hand of the apparatus, as viewed in FIG. 2.

Guide member 38*b* is movable transversely as by an air cylinder (not shown) to align the container with guide member 38*a*. Guide member 38*b* is actuated by the incoming container blocking an electric eye beam. The guide member 38*b* is returned to its "home position" (as shown in FIG. 4) when the band or strap is applied. A container sensing switch assembly 46, which includes an upwardly biased piston 46*a* (while the elevator is descending) is provided for use as a safety device to be sure that the load descends with the elevator and does not get stuck up in the folding mechanism after a banding operation. The piston 46*a* tries to extend above the elevation of conveyor 35 while the elevator descends. If the container remains on the elevator, the piston 46*a* will not be able to extend far enough for the cam 46*b* to actuate switch 46*c*. The container tube is aligned with end stops and guide members 38*a* and 38*b* by the power driven rollers. End stops 38*a* and 38 *b* are pivotally mounted and rotate after the folding operation to allow the container to pass to conveyor 22.

Elevator 34 is raised and lowered by a hydraulic cylinder 45, as is known in the art, to cooperate with the folding mechanisms to be described below.

The present invention contemplates the use of folding apparatus 20 in an assembly line in which container tubes of varying dimensions will be encountered. To this end the folding apparatus is controlled by an operator who stands on a platform 50 adjacent the folding apparatus. As a container tube approaches onto elevator 32, the operator selects a closure cap C corresponding to the container tube and places it in the cap conveyor mechanism 55, FIG. 2. Since the folding apparatus is designed for use with variable size containers, the cap conveyor 55 is adapted to adjust the folding apparatus to the particular size of cap and container to be used.

Figure 5:
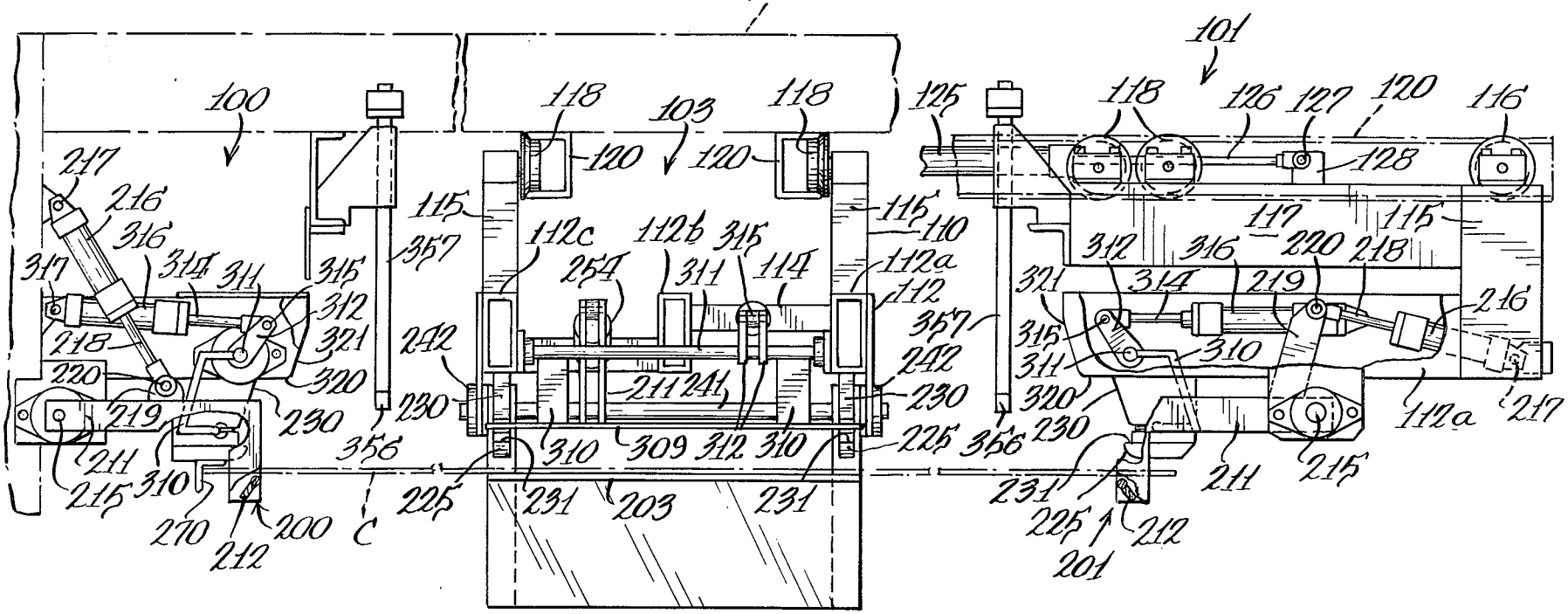
FIG. 5 is an enlarged fragmentary sectional view taken generally along line 5—5 in FIG. 1 illustrating the folding mechanisms.
Figures 6, 7, 8:
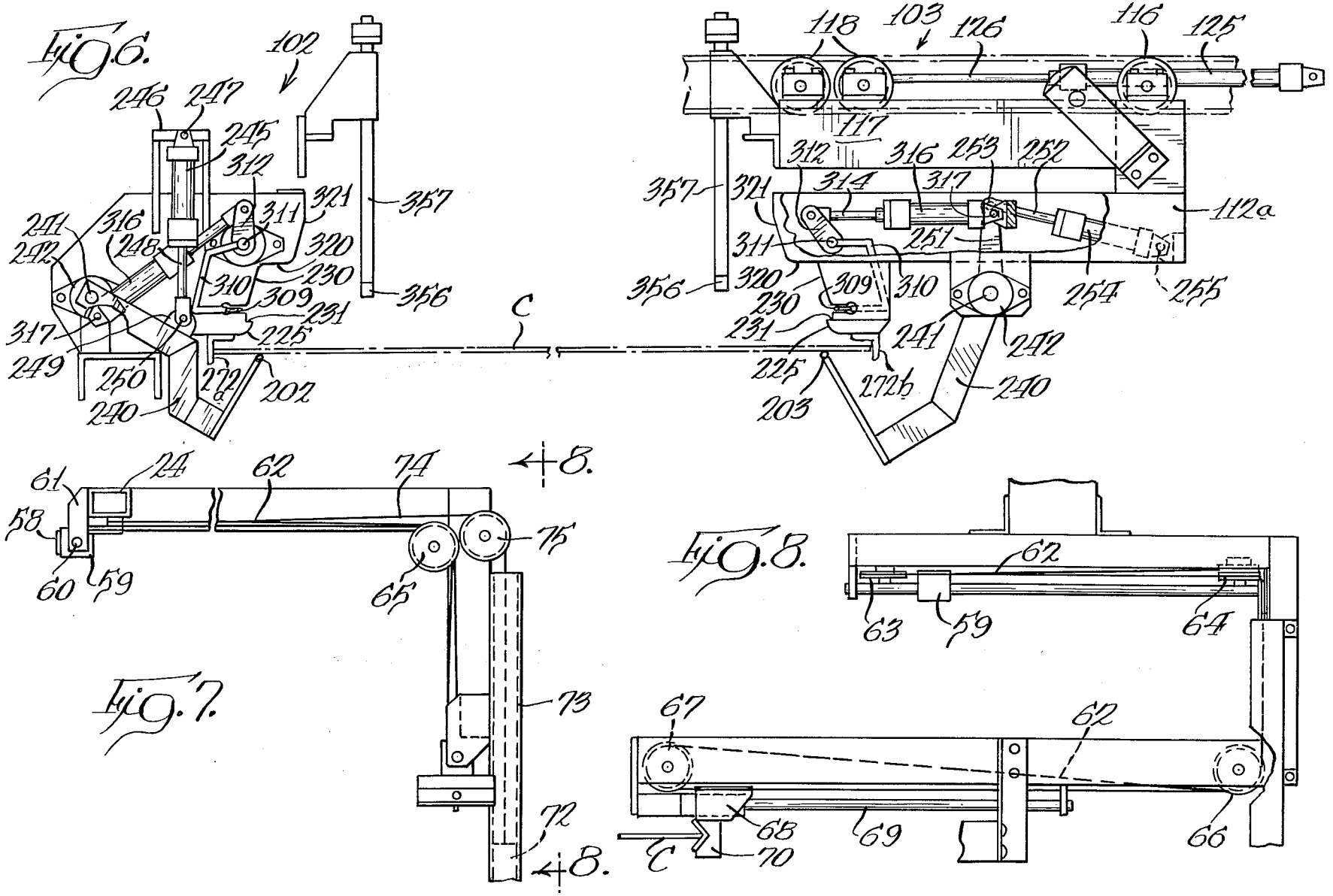
FIG. 6 is an enlarged fragmentary sectional view taken generally along line 6—6 in FIG. 1 illustrating the transverse folding mechanism.
FIG. 7 is an enlarged sectional view taken generally along line 7—7 in FIG. 1 illustrating the cap width adjusting mechanism.
FIG. 8 is a sectional view taken generally along line 8—8 in FIG. 7.

Referring to FIGS. 5 and 6, there are shown two pairs of folding mechanisms 100, 101, 102, and 103, which define a generally rectangular-shaped folding area therebetween. Folding mechanisms 101 and 103, FIG. 5, are each mounted on a trolley system for movement towards and away from the folding area to provide for adjustment to cap size. Each trolley 110 includes a folding mechanism support 112 having spaced apart support channels, three of which, 112*a*, 112*b*, and 112*c*, are illustrated in FIG. 5 and which are interconnected at their outer ends by means of channel 114 to support the folding mechanisms, to be described below. Extending upwardly from channels 112*a* and 112*c* are vertical support members 115 which mount a trolley roller 116 at their upper ends. Extending inwardly from the upper end of members 115, above the folding mechanisms, is a longitudinal support member 117 which positions a pair of trolley rollers 118 above the free ends thereof.

Trolley rollers 116 and 118 are received in an outwardly opening generally U-shaped track guide 120 attached to the lower surface of the top of frame 24 to support mechanisms 101 and 103 therefrom. Each mechanism 101 and 103 is moved in and out by means of a hydraulic cylinder 125 which is pivotally attached at its base end to the frame 24. A piston rod 126 which extends outwardly from each cylinder 125 is pivotally attached by a pin 127 to a tab 128 extending upwardly from the trolley. In this manner, as piston rod 126 is moved within cylinder 125, the respective folding mechanism is moved inwardly or outwardly.

Figure 11:
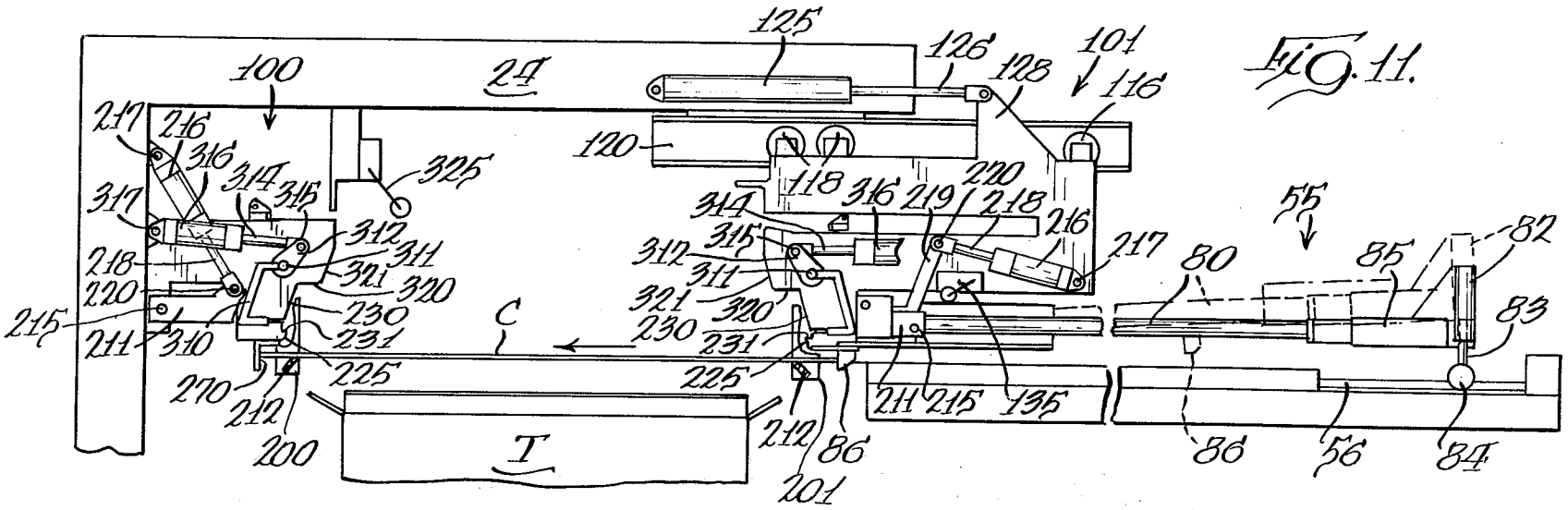

Referring to FIGS. 5 and 11, folding mechanism 101, referred to as the longitudinal, adjustable, folding mechanism, and mechanism 103, referred to as the transverse, adjustable, folding mechanism, are adjusted independently. As a container tube moves onto conveyor 32, the operator selects a container cap C, FIG. 1, and inserts it onto the cap conveyor 55. The adjustable folding mechanisms 101 and 103 start from a fully extended position and are moved inwardly by hydraulic cylinders 125 in response to the size of the cap to be used, as will be discussed below.

The cap conveyor 55 consists of a platform 56 on which the cap C is placed. Control for movement of the hydraulic cylinder 125 for mechanism 103 is controlled by an electric eye switch 57 carried on mechanism 103, FIG. 1. When the operator actuates the folding apparatus, the transverse folding mechanism is drawn inwardly by cylinder 125 until the electric eye 57 receives an input signal from a reflector 58 indicating that the proper position of the mechanism has been achieved.

Reflector 58, FIGS. 1 and 7, is carried on a slide block 59 which is slidably mounted on a rod 60 (FIG. 8) extending transversely of the apparatus adjacent electric eye 57. Rod 60 is mounted in a carriage assembly 61 which is attached to frame 24. Carriage assembly 61 includes two generally L-shaped portions positioned at right angles to each other. Slide block 59 is attached to an endless cable 62 which is payed about a system of pulleys, FIGS. 7 and 8, including a single pulley 63 rotatably mounted to assembly 61 at the inner end of rod 60; a double pulley 64 rotatably mounted at the outer end of rod 60; a double pulley 65 mounted at right angles and spaced longitudinally from pulley 64; a double pulley 66 mounted below pulley 65 and rotated 90° therefrom; and a return pulley 67 mounted at the end of the L-shaped portion of carriage assembly 61 above the cap conveyor 55.

Attached to the lower reach of cable 62 between pulleys 66 and 67 is a trolley mechanism 68. Trolley mechanism 68 is slidably mounted on a rod 69 extending transversely of the cap conveyor. Depending from trolley 68 is a V-shaped cap flange pickup member 70 which opens towards platform 50 to receive the edge of the leading transverse flange of cap C as it is inserted into the cap conveyor. In this manner, as a new cap is placed onto the cap conveyor, the cap flange engages member 70 and moves it to the right, as viewed in FIG. 8, thereby moving slide 59 to a corresponding "set" position for transverse folding mechanism 103.

Trolley 68 is returned to the position illustrated in FIG. 8 by means of a weight 72, FIG. 7, which is positioned in a vertical channel 73 and attached to the endless cable 62 between pulleys 64 and 65 by means of cable 74. Cable 74 is payed over a pulley 75 above tube 73 to transform the vertical tension created by weight 72 into a horizontal component for moving the cable 62 to a reset position after the cap has been fed from the cap conveyor.

Referring to FIG. 11, the longitudinal folding mechanism 101 is adjusted by the cap conveyor 55. To this end, cap conveyor 55 includes a longitudinally-extending boom 80 which is pivotally attached to mechanism 101 at one end by pivot mount 81 (FIG. 1) and is positioned by a vertical air cylinder 82 at its opposite end. Piston rod 83, extending downwardly from cylinder 82, includes a roller 84 at its free end which bears against platform 56 to raise and lower the boom 80 to provide easy access to the cap conveyor for loading a new cap, as discussed below. A second air cylinder 85 is mounted longitudinally on boom 80 to operate a downwardly facing cap feed member 86 which is mounted at the end of the piston rod of cylinder 85. Feed member 86 engages the longitudinal outer flange of cap C to feed the cap to the left, as viewed in FIG. 11.

Figure 9:
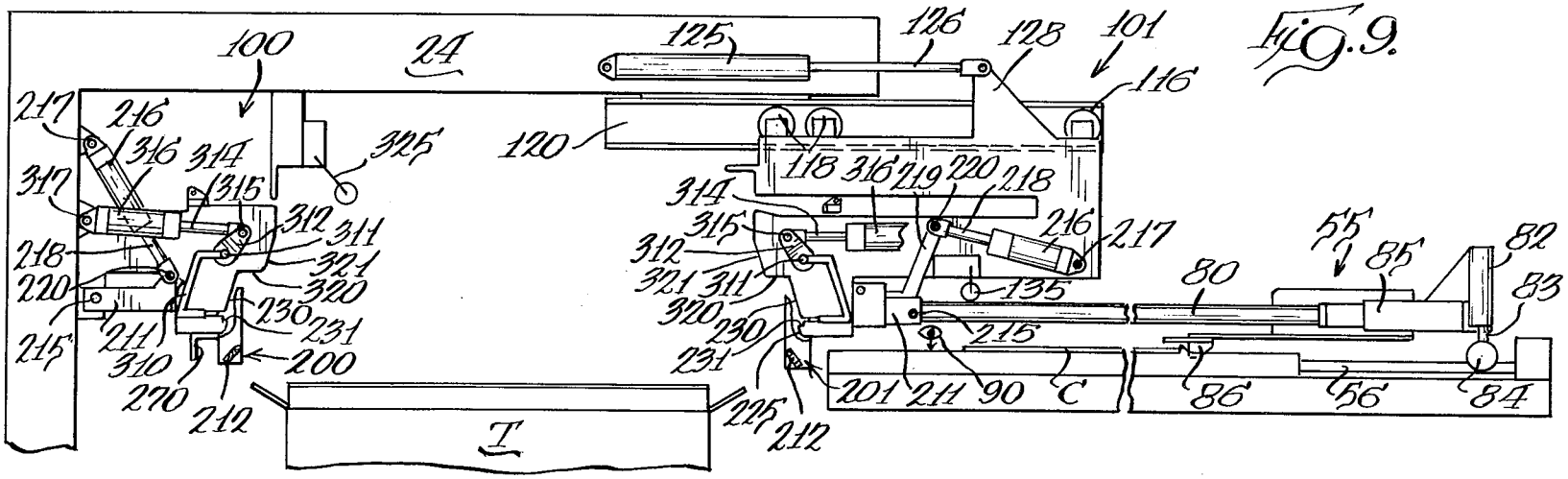
FIGS. 9–14 are schematic views illustrating the operation of the folding mechanisms.
Figure 10:
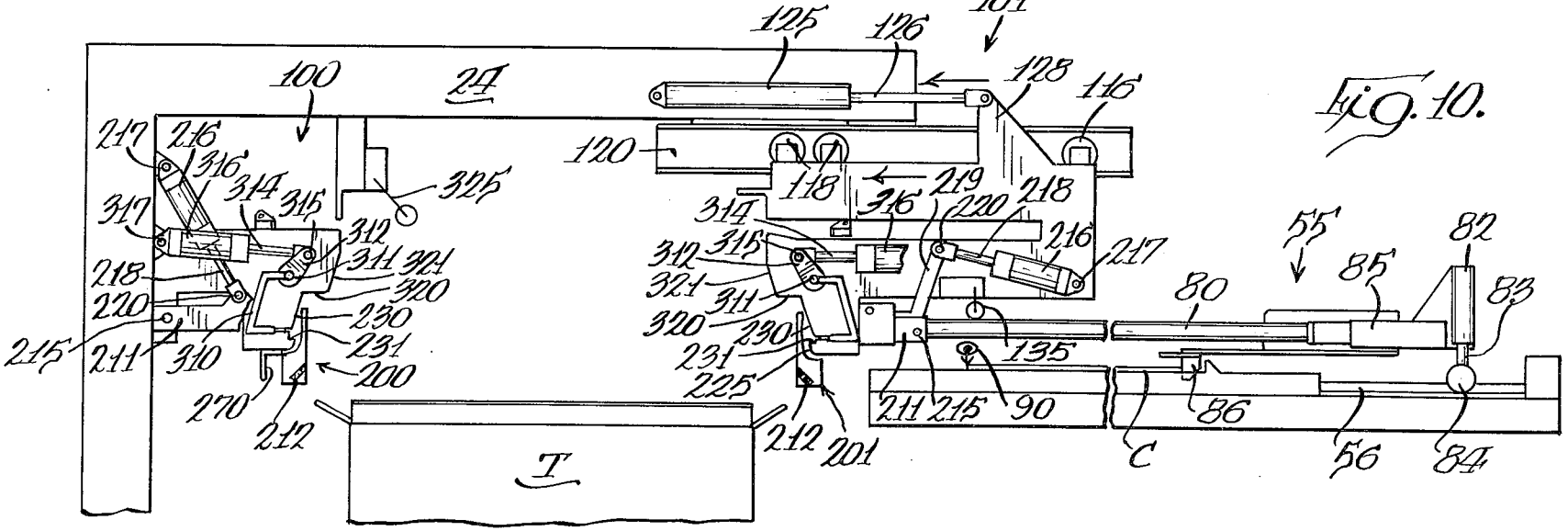

FIG. 9 illustrates the position of the cap C immediately after its insertion into the cap conveyor. It will be recalled that folding mechanism 101 is in the fully retracted position so that when the operator actuates the folding apparatus, the trolley mounted folding mechanism 101 moves to the left causing feed member 86 to engage the trailing longitudinal end of the cap and move it forwardly on platform 56. As cap C moves forwardly, the leading edge of the cap interrupts a photoelectric cell 90, as indicated in FIG. 10. Photocell 90 terminates the inward movement of piston rod 126 to set the longitudinal dimension of the container cap cavity.

Since photocell 90 is mounted on frame 24, the throw of feed member 86 is constant and sufficient to transfer the cap into the folding area independently of the size of the cap.

The cap conveyor 55 feeds the cap C into the folding area defined by folding mechanisms 100, 101, and 102 and 103. The cap is fed forwardly onto a set of first folding members 200, 201, 202, and 203, FIGS. 6 and 11, which support the cap flanges above the container tube T on the elevator 34. After the cap has been fed into the folding area, feed member 86 trips switch 135, FIG. 11, to initiate operation of the first folding members, to be described, and to return feed member 86 to the retracted position and actuate cylinder 82 to raise the cap conveyor boom 80 to facilitate insertion of a new cap C.

The first folding members differ somewhat in structural detail, but perform the same basic function. The longitudinal first folding members 200 and 201 are best illustrated with reference to FIGS. 11 and 12. Each of the folding members includes a transversely disposed member 210 which extends between two spaced apart L-shaped pivot brackets 211. Members 210 are reinforced by means of a generally rectangular shaped member 212 positioned therebeneath and attached thereto as by welding. Folding members 200 and 201 are shown in the cap receiving position in FIG. 11 in which the cap is supported thereon in a flat position. Each L-shaped member 211 is pivotally mounted for rotation about a pin 215 and pivoted thereabout by means of an air cylinder 216. Cylinder 216 is pivotally attached at one end to the frame by pin 217. A piston rod 218 extending from each cylinder 216 is pivotally attached by pin 220 to a tab 219 which extends upwardly from bracket 211. As piston rod 218 is drawn inwardly, member 211 pivots about pin 215 to raise the folding members 200 and 201 to a position illustrated in FIG. 12. Each folding mechanism defines an arcuate bearing surface 225 immediately above each folding member 200 and 201 which overlie the peripheral portions of the cap flanges. Immediately above bearing surfaces 225 is a downwardly tapered flange receiving cavity 230 which terminates in a ledge 231 at its lower portion, immediately adjacent bearing surface 225. In this manner, as first folding members 200 and 201 are raised, the cap flange portions extending outwardly of the folding members bear against surface 225 to cause the flange portion to bend about members 210 to produce a first fold portion. As the folding members continue to be rotated, the cap is lifted and the first fold portion is introduced into cavity 230 and the outer edge of the cap flange is positioned on ledge 231. Due to the tendency of the first fold portions to return to a flattened position, the cap is maintained within cavities 230.

The transverse folding mechanisms 102 and 103, FIG. 6, have first folding members in the form of elongated rods which are supported from upwardly facing, generally L-shaped members 240 which are pivotally attached to the frame by rod 241 and bearing 242. The left-hand folding mechanism 202 is pivoted upwardly by an air cylinder 245 which is disposed vertically and attached to an inverted, U-shaped bracket 246 by pin 247. Piston rod 248, extending downwardly from cylinder 245 is pivotally attached to a tab 249 by means of pin 250.

The right-hand first folding member 203 includes a pair of upwardly extending pivot members 251 which are attached to rod 241. The upper ends of members 251 are pivotally attached to a piston rod 252 extending from cylinder 254 by pin 253. Cylinder 254 is pivotally attached at its base to the folding mechanism frame by pin 255. It will be appreciated that the operation of the transverse folding mechanisms is similar to that previously described for the longitudinal folding mechanism in that the flanges of the cap are brought into engagement with a bearing surface 225 to produce a first fold, and the first fold portion is deposited on a ledge 231 within a downwardly tapered cavity 230.

As the cap is fed by the cap conveyor 55 into the folding area, the flange edges adjacent the folding mechanisms 100, 102, and 103 engage downwardly facing, L-shaped stops 270 (FIG. 5) and 272a and 272b (FIG. 6) mounted respectively thereon.

After the first fold has been produced in the cap, the first folding members are returned to the start position illustrated in FIG. 5 and the elevator 34 lifts the container tube T upwardly. As the container tube is elevated, the height of the tube wall is sensed by switch 300, FIG. 1, which contacts the edge of the tube. Switch 300 actuates second folding members, to be described, as the top of the tube wall reaches the elevation of ledges 231. As the tube continues to rise, the second folding mechanisms are actuated to cause the first fold portion of the cap flange to be folded around the flange of the container tube to substantially encompass the flange, as illustrated in FIG. 13.

The second folding mechanisms on each of the four folding mechanisms are similar in construction and are correspondingly numbered. With reference to FIG. 13, each second fold mechanism includes an elongated member 309 which is supported at the free ends of generally U-shaped folding members 310. Members 310 are pivotally mounted to the folding mechanism frame by rod 311 and positioned with the base of the U-shaped substantially perpendicular to the flat portion of the container cap and rod 309 adjacent the cavity. A pair of pivot links 312 is attached to rod 311 and extend upwardly therefrom to be attached to an air cylinder piston rod 314 by pin 315. Piston rod 314 extends inwardly towards the container cap from a generally horizontally mounted air cylinder 316 which is pivotally attached at its out end to the folding mechanism frame by pin 317.

Figure 13:
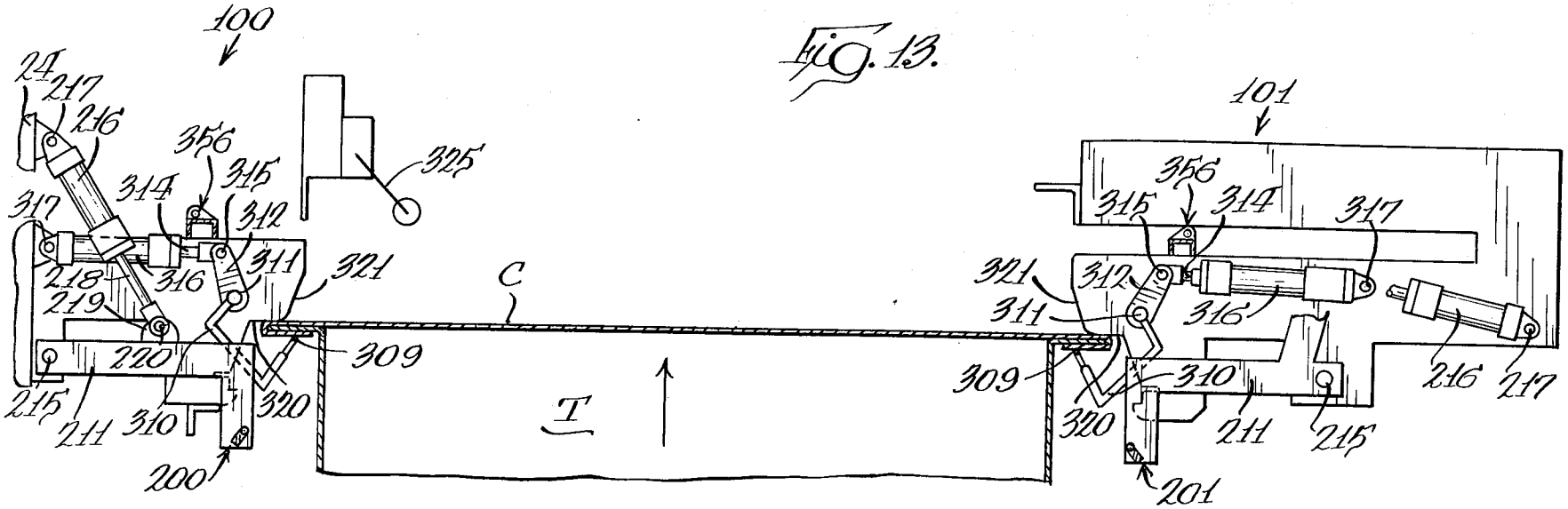

As the container tube T triggers switch 300, piston rods 314 are withdrawn into cylinders 316 to cause the U-shaped folding member 310 to be pivoted by rod 311 thereby placing rod 309 in engagement with the first fold portion of the cap and folding it about the container tube flange, FIG. 13. Immediately above the access cavities 230 are horizontal surfaces 32D which bear against the folded flanges of the cap to cooperate with the second folding members so that the container flanges are substantially encompassed by a U-shaped cap flange.

Figure 14:
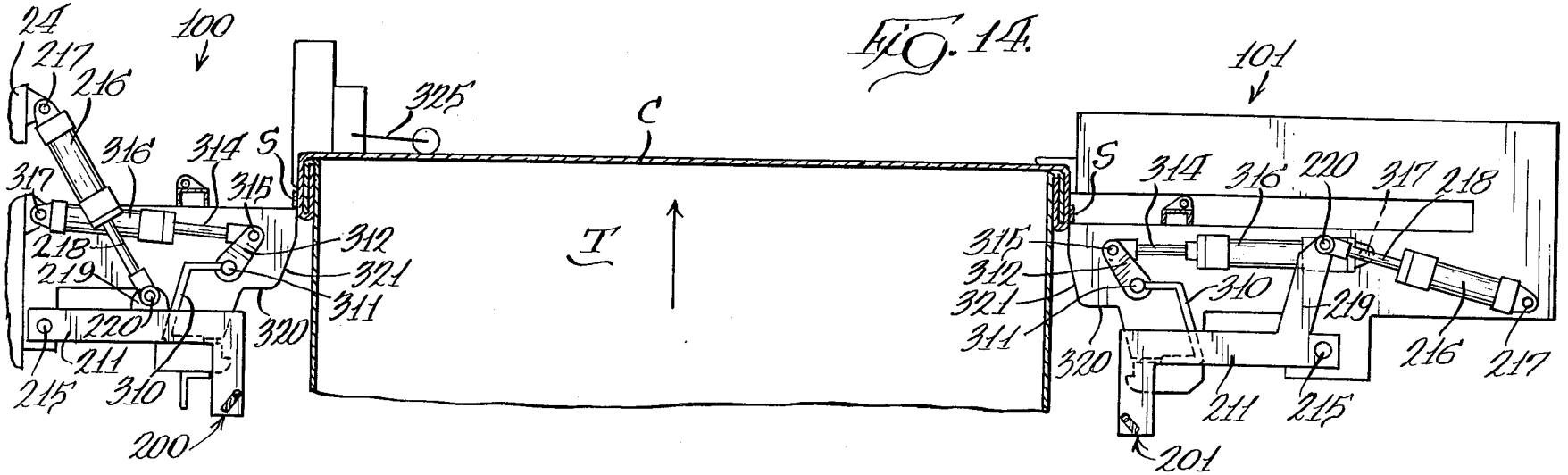

Extending upwardly from horizontal surface 320 is a downwardly tapered bearing surface 321 which causes the flanges to be folded inwardly into essentially parallel relationship with the walls of the container tube as the tube is raised, as best illustrated in FIG. 14. As the tube continues to move upwardly, it trips a third sensing switch 325 which terminates the upward movement of the elevator 34. As the flanges come into contact with tapered surfaces 321, the second folding members are returned to the retracted position thereby eliminating any possibility of the folding members being caught between the flanges and the wall of the tube T.

At this point the folding operation has been completed and a ligature is placed about the periphery of the cap flange. To this end a strapping head 350, FIG. 1, is provided. Strapping head 350 receives straps, which may be in the form of plastic or steel strapping from a roll supply 351. Strapping head 350 pulls the strap through vertical guide 355 and feeds it through a generally rectangular shaped chute 356, which is positioned at the same elevation of the final fold of the interlock container and cap by brackets 357, FIGS. 5 and 6. As is well known in the art, chute strapping mechanisms encompass the container with strapping, tension the strap, place a seal on the strap, and sever the strap from the coil. After the ligature has been attached, the elevator is lowered to bring the container tube to the elevations of the output conveyor 22. When the elevator 34 has reached this elevation, the drive to rollers 36 is initiated and the capped carton is fed to conveyor 22. As the tube is lowered, the movable folding mechanisms are retracted to open the folding cavity to its fullest extent preparatory to another cycle.

METHOD OF OPERATION

While the operation of the folding apparatus of the present invention has been described above in connection with the structural details thereof, a brief description will be given to facilitate understanding of the folding operation.

With reference to FIG. 2, a container tube T is delivered from the input conveyor 21 to the transfer conveyor 32. The operator selects a cap corresponding to the size of the container tube and places it onto the cap conveyor 55. As the cap is inserted into the cap conveyor, the transverse dimension of the folding area is sensed and adjusted by means of trolley 68, FIG. 8. The container tube is then transferred to the lift conveyor 35 and centered thereon against end stops and guide rails 38a and 386. The longitudinal folding mechanism trolley is moved inwardly causing the cap C to interrupt photocell 90, FIG. 9, and thereby size the longitudinal dimension of the folding area.

Figure 12:
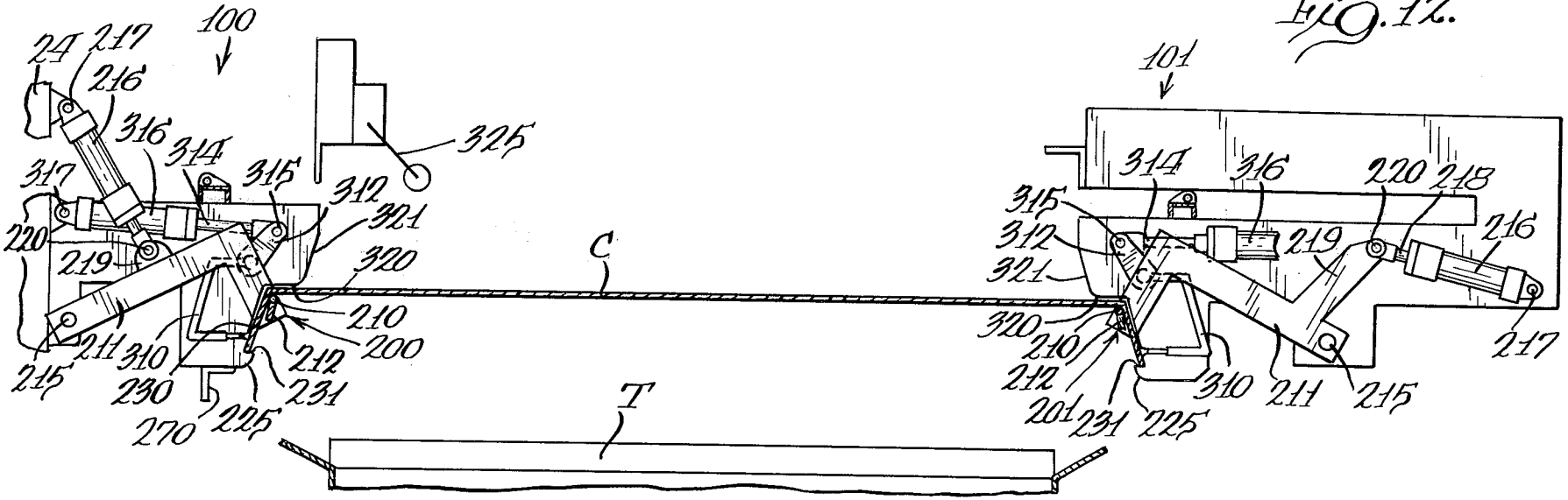

When photocell 90 has been blocked, the folding mechanism trolley stops and the container cap is fed forwardly onto the first folding members by the cap conveyor. As the cap is fed into the folding area, switch 135, FIG. 11, is interrupted at the end of the stroke to cause feed member 86 to be retracted and boom 80 raised for subsequent insertion of a new container cap. Switch 135 also actuates the first folding members to cause the container cap to be lifted upwardly into engagement with the bearing surfaces 225, 260 to cause the outer portions of the flange to bend about the first folding members and to be received in the cavities as illustrated in FIG. 12. As soon as the container cap has been folded, the first folding members are retracted and the container tube is raised by elevator 34.

As the container tube is raised and the tube trips switch 300, FIG. 1, the second folding members are actuated to cause the first fold portions to be folded into underlying relationship with the container tube flanges as illustrated in FIG. 13. It will be appreciated that the folding of the cap flanges is done "on the fly" as the container tube is raised and that there is no mechanical linkage between the container tube and folding mechanisms. This arrangement results in an extremely smooth synchronized motion which provides good reliability in high output assembly line production.

As the elevator continues to raise the container tube, the flanges are brought into engagement with bearing surfaces 321 which cause the flanges to be folded inwardly relative to the container to present the flanges in essentially parallel relationship with the wall of the container tube. The container continues to move upwardly until the upper limit switch 325 is tripped at which time the elevator stops and the strapping head secures the strap about the flange as illustrated in FIG. 14. The movement of the flanges on working surfaces 321 allows the second folding members to be clear of the flanges as they are folded into parallel relationship with the container wall. After the ligature has been fastened, the elevator lowers the container, the folding mechanisms trolleys move outwardly to a fully extended position and the capped container is fed onto the output conveyor 22 and the entire cycle is complete.

It is, of course, intended to cover by the appended claims all such changes and modifications as fall within the true spirit and scope of the invention.

What is claimed is:

1. Method of providing and securing a cap to a flanged open end container comprising the steps of selecting a cap corresponding to the size of the container tube, inserting a cap on a cap conveyor and sensing the transverse dimension of the folding area, lifting the cap and conveying the cap over the open end of the container, which cap includes an outer peripheral portion extending outwardly of the container flange, folding the peripheral portion of the cap extending outwardly of the container flange, elevating the container into position under the cap wherein the container flange is disposed within the peripheral portion of said cap, folding the cap flange to encompass the container flange to form a flange assembly, folding said cap and container flange assembly into parallel relationship with the sidewalls of said container and securing a ligature about the cap and container flange assembly to affix the cap to the container.

2. Apparatus for providing a folded cap on a container tube having a flanged open end, which cap includes an outer flange portion comprising frame means; first cap flange folding means mounted on said frame means including a flange support member adapted to support said cap flange thereon; means for pivotally mounting said flange support member on said frame means, means located on said frame means above said flange support member defining a first arcuate bearing surface and a downwardly tapered cavity terminating in a ledge above said bearing surface; means for pivoting said flange support member to cause the outer portion of said cap flange to bear against said bearing surface and bend downwardly around said flange support member to form a first fold portion, said flange support member positioning the first fold portion in said cavity and the free end of said cap flange on said ledge, whereby said cap is supported on said ledge; means for elevating said container tube into engagement with the flat portion of said cap between said first fold portion; second folding means adapted to fold said first fold portions into underlying engagement with said container flange as said container is elevated; means mounted on said frame means for folding said cap and container flanges into parallel relationship with the wall of said container as said container rises, whereby the said cap flange is interlocked with said container flange.

3. The apparatus of claim 2 wherein said second folding means is constructed and arranged to engage said first fold portion in said cavity as said container tube is elevated and pivot said first fold portion in underlying relationship with the container tube flange.

4. The apparatus of claim 3 wherein said means for folding said flanges into parallel relationship with said container wall includes a downwardly tapered bearing surface located above said cavity and overlying said cap flange, said downwardly tapered bearing surface being adapted to engage said flanges as said tube is elevated to cause said flanges to be folded as said flanges are moved relative thereto.

5. For use in combination with apparatus for securing a ligature about a container which includes an inner container tube and a top container cap; said tube having a flange including a first portion adapted to extend outwardly of the top of the tube and a second portion adapted to extend downwardly from the end of the first portion; said cap having a flange including a first portion adapted to extend downwardly outside of the second portion of said tube flange, a second portion adapted to extend inwardly from the end of said cap flange first portion, and a third portion adapted to extend upwardly from the end of said second portion inwardly of the second portion of said container flange; a flange folding apparatus comprising: frame means; container tube elevator means and conveyor means on said frame means, said conveyor means being adapted to move said container tube to said elevator means; cap folding mechanism mounted on said frame means above said elevator means; means for feeding a cap to said folding mechanism, said folding mechanism including first folding means adapted to support said cap flange thereon; means defining a pivot axis on said frame means for said first folding means; means defining a first bearing surface above said first folding means, said bearing surface being disposed transversely of said cap flange and further defining a downwardly tapered pickup cavity terminating in a ledge above said bearing surface; means for pivoting said first folding means about said axis to cause said cap flange to engage said first bearing surface and bend about said first folding means to produce said third cap portion, means for initiating operation of said elevator means subsequent to formation of said third portion; second folding means adapted to fold said third portion about said second portion of said container as said container is elevated; means defining a downwardly tapered second bearing surface above said cavity, said second bearing surface adapted to engage said flanges and fold them in parallel relationship with said container tube; means for terminating the upward movement of said elevator subsequent to said parallel folding; and means for securing a ligature about said flanges to affix said cap in place relative to said container.

6. Apparatus for providing a folded cap on a container tube having a flanged open end and a flanged cap in which the outer portion thereof is positioned adjacent the wall of the tube which comprises a support means; first cap flange folding means mounted on said support means and adapted to support the cap flange thereon; means defining a bearing surface above said first folding means transversely of said cap flange and further defining a downwardly tapered pickup cavity terminating with a ledge above said bearing surface; means defining a pivot axis on said support means for said first folding means, said first folding means being adapted to raise said cap vertically to cause said cap flange to bear against said bearing surface and bend about said first folding means to form a first fold portion, the free end of said cap flange being supported on said ledge subsequent to said first folding; means for elevating said tube with its flange extending outwardly of the tube wall; second folding means adapted to engage said first cap fold portion as the upper end of said tube rises above said ledge to dislodge said first cap fold portion from the ledge; a second bearing surface including a horizontal portion adapted to engage said cap flange adjacent said first fold portion and cooperate with said second folding means to cause said first cap fold portion to be positioned in underlying relationship with said tube flange to encompass said tube flange, and a downwardly tapered bearing surface adapted and arranged to cause said cap flange and tube flange to be folded, whereby said first cap fold portion is placed in juxtaposition with the wall of said tube as said tube is elevated.

7. Apparatus of claim 6 further including means for feeding a container cap onto said first cap flange folding means.

8. Apparatus of claim 7 further including means for providing lateral adjustment of said folding means whereby container caps of various dimensions may be accommodated.

* * * * *